US005211034A

United States Patent [19]

Berti

[11] Patent Number: 5,211,034

[45] Date of Patent: May 18, 1993

[54] DEVICE FOR PRODUCING A YARN USING FIBERS RETAINED IN A TUBULAR KNITTED MANUFACTURED ARTICLE

[75] Inventor: Emanuele Berti, Sesto Fiorentino, Italy

[73] Assignee: Compagnia Meccanotessile S.r.l., Vaiano, Italy

[21] Appl. No.: 747,676

[22] Filed: Aug. 20, 1991

[30] Foreign Application Priority Data

Aug. 23, 1990 [IT] Italy ..... 9472 A/90

[51] Int. Cl.[5] ..... D04B 9/44

[52] U.S. Cl. ..... 66/9 A; 66/9 B

[58] Field of Search ..... 66/9 A, 9 B, 123

[56] References Cited

U.S. PATENT DOCUMENTS

| | | | |
|---|---|---|---|
| 2,387,191 | 10/1945 | Stover | 66/9 A |
| 2,425,293 | 8/1947 | McDermott | 66/9 A |
| 2,468,870 | 5/1949 | Eskow | 66/9 A |
| 2,520,010 | 8/1950 | Lerch | 66/123 X |
| 2,609,312 | 9/1952 | Farrell | 66/9 A X |
| 5,027,594 | 7/1991 | Gamberoni et al. | 66/9 B X |

*Primary Examiner*—Clifford D. Crowder
*Assistant Examiner*—John J. Calvert
*Attorney, Agent, or Firm*—McGlew & Tuttle

[57] ABSTRACT

A feeding cylinder (210) feeds a corresponding roving or top of fibers to be opened using a rotating card (206) which separates the fibers of the roving, and supplies them to a conveying cavity (214). A yarn guide (244), feeds tying yarn to a knitting machine capable of forming a tubular knitted manufactured article, and is arranged around a neck (240) for discharge of the opened fibers. Needles (256), during working, are also external to said neck.

7 Claims, 1 Drawing Sheet

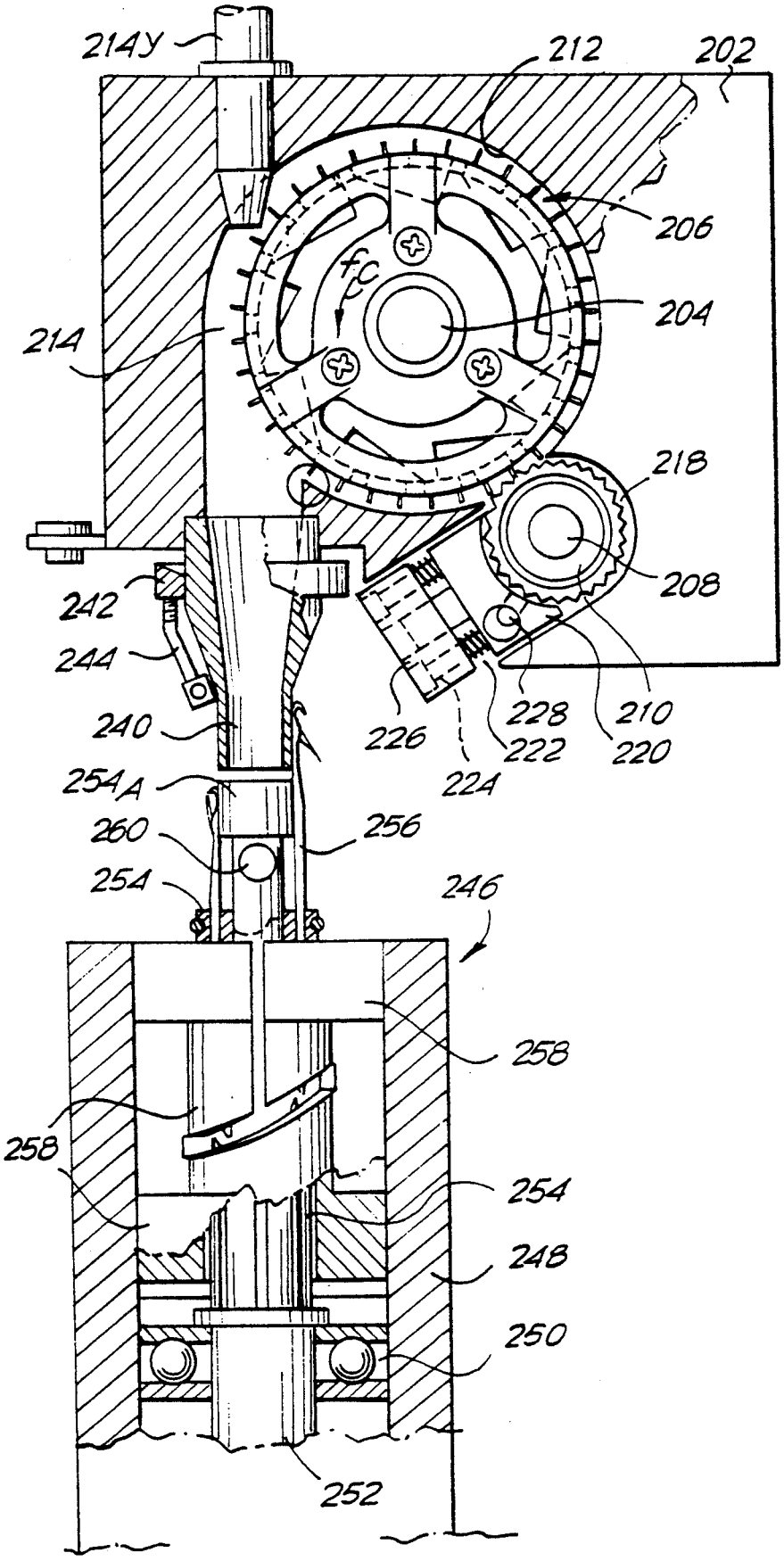
214Y
212
202
206
fc
204
214
218
208
242
244
240
226
228
222
210
220
224
254A
260
256
254
246
258
258
254
248
250
252

DEVICE FOR PRODUCING A YARN USING FIBERS RETAINED IN A TUBULAR KNITTED MANUFACTURED ARTICLE

FIELD OF THE INVENTION

The present invention relates in general to a device for producing yarn and in particular to producing a yarn where fibers are blown into a tubular knitted manufactured article and retained in the article during the knitting of the article and also retained through a filtering process which traps the fibers in the article as the air blows through the article.

BACKGROUND OF THE INVENTION

A known device, described inter alia in European application no. 88830477.1 (no. 0317.523), is capable of forming a yarn constituted by a linear manufactured article made of tying yarn, in particular a tubular knitted manufactured article, with opened fibers which are anchored to the stitches and project at least partly externally in order to impart a raising effect to the composite yarn thus formed.

The device for producing the yarn comprises at least one means of feeding a corresponding roving or top of fibers to be opened, at least one rotating card member, to which the roving is fed, which card member separates the fibers of the roving, means forming a cavity for conveying the opened fibers, a typing chamber with yarn-guide passages for the penetration into it of typing yarns, and means of working the tying yarns in order to form with these a filiform manufactured article engaging the opened fibers fed to the tying chamber. These means for working of the tying yarns comprise—in one of the embodiments described—a knitting machine capable of forming an essentially filiform tubular manufactured article. The working zone of the needles is inside the tying chamber. The knitting machine is circular, has a limited number of needles and is of the type forming thin tubular manufactured articles using one or more feeders and using a continuously rotating device which carries the needles or the means for control of the needles.

SUMMARY AND OBJECTS OF THE INVENTION

The invention relates to a device which is improved in relation to what has been indicated above and which offers numerous advantages which will become clear from reading the text which follows.

The knitting machine sets the needles in operation around a neck for discharge of the opened fibers from the conveying cavity, the tying yarn or yarns being fed on the outside of the neck.

The device comprises an axially hollow cylinder, along and on the outside of which the needles, controlled by a cam, are slidingly guided. The tubular manufactured article has the fibers being developed within the continuous axial cavity of the cylinder. According to the invention, the neck can be made to end opposite the upper end of the cylinder and a at a limited distance from it, as a result of which the tips of the needles, raised for working, border the neck externally.

Advantageously, there can be provided lateral holes from the continuous axial cavity of the cylinder of the needles towards the outside, for the discharge of air for transport of the opened fibers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The single drawing in this application is a general diagrammatic cross-section of the device.

DETAILED DESCRIPTION OF THE PREFERRED EMBODIMENT

According to the drawing, 202, indicates a block, in which a rotation seat is formed for a shaft 204 carrying a card which is generally indicated by 206. A second rotation seat with eccentric bushing serves for a shaft 208 carrying a feed cylinder 210. By adjusting the angular position of the eccentric bush of the shaft 208, the position of the cylinder 210 in relation to the card 206 is adjusted. The block 202 forms a housing 212 for the card 206, shaped with a radial dimension which increases in the direction of rotation of the card 206 and indicated by the arrow fc. The cavity defined by the housing 212 and by the card 206 increases radially from the feed cylinder 210 and extends into a conveying cavity 214. The conveying cavity 214 extends tangentially in relation to the housing 212 for the card 206 and to the card itself. The feed cylinder 210 is received in a housing 218 which is defined in part by the block 202 and in part by an adjustment block 220 which is loaded towards the cylinder 210 by springs 222 wound around guide rods 224 carried by a support 226. In the block 220, a hole 228 is made, which is inclined and starts laterally, in order to supply the top or roving of fibers to the feed cylinder 210. The feed cylinder 210 is made to rotate in relatively slow manner and its speed is adjustable. The card 206, carried by the shaft 204, is made in the form of a rotor in order to draw in air and to force it into the cavity 212 and then into the cavity 214. By means of the rotation of the card 206, the fibers fed from the cylinder 210 are picked up and opened by the card 206. The rotation of the card gives rise to a current of air radially in the centrifugal direction, which favors the transport of the opened fibers towards the housing 212 and towards the cavity 214. Downstream of the cavity 214, a feed of tying yarns is provided to engage the fibers distributed by the card, as is described more clearly below.

By varying the speed of rotation of the feed cylinder 210, it is possible to vary the characteristics of the yarn to be formed. In particular, it is possible to obtain fancy yarns by operating the feed cylinder intermittently using various systems, controlled by a programmed central unit, and also using a combination of different feeders. In fact, it is also possible to provide two or more feed cylinders 210 along the periphery of one and the same card 206, and possibly operate with variations in speed from zero to a maximum. Also two or more cards can be provided in order to supply different fibers to the same cavity 214, so as to vary the type and/or quantity of the fibers at the card. It is also possible to feed irregular rovings, with possible neps of fibers.

The conveying cavity 214 extends to and ends in a neck 240. Around this neck, there is developed a ring 242 which carries one or more yarn-guides 244 on the outside of the neck 240 itself.

The neck 240 is developed vertically and, below it and coaxially with it, there is provided a knitting machine, indicated generally by 246. In particular, 248 indicates the external casing of the machine, which carries bearings such as 250 in order to support a shaft 252 which is made to rotate suitably. The shaft 252 is perforated axially and, in its upper part, constitutes the cylinder 254 with the typical longitudinal tricks for accommodating the needles 256 which slide vertically, that is to say parallel to the axis of the shaft 252 and cylinder 254. In the upper part of the external casing 248, a shell 258 is accommodated, which forms the cam for control of the needles by means of the respective butts, in a manner known per se. The cam is capable of bringing about at least one raising and lowering stroke of the needles 256 for the formation of tubular manufactured article using a respective thin yarn fed from the yarn guide 244 and taken by the needles as they are raised. A slot in the cam shell 258 is provided in order to allow the replacement of the needles. During raising, the needles are situated on the outside of the end part of the neck 240 which is opposite the cylinder of the needles 254 and in particular opposite the extension 254A of this cylinder 254. The extension 254A is hollow in order to allow the passage of the manufactured article which is formed by the needles working around the neck 240. The extension 254A can have one or more lateral holes 260 which serve for the discharge of the air for transport of the fibers, coming with the opened fibers from the conveying cavity 214. The transport air also escapes from the relatively limited interspace between the end edge of the neck 240 and the upper end of the extension 254A of the cylinder 254. The escape of the air, both from the interspace between neck and extension 254A and from the holes 260, takes place with passage of air through the knitted manufactured article formed by the needles 256. As a result of which at least the greater part of the fibers which are drawn along by the air coming from the conveying cavity 214 are retained by the stitches of the manufactured article formed by the needles 256.

The formation of the manufactured article around the exit neck 240 for the opened fibers allows many advantages in relation to the know arrangement. Among these, there can be singled out better access to the needles for replacement and maintenance. Another advantage is better meshing with the stiches of the yarn, which derives from more precise and feasible adjustment of the external yarn-guide in relation to the needles (previously the distance of the yarn-guide was conditioned by the shape of the formation neck). Also obtained is a good take-up of the fibers on the part of the stiches under formation of the tubular manufactured article formed by the machine 246, as the formation of the manufactured article takes place on the outside of the neck 240 in order to collect the fibers which otherwise may escape through the interspace between the neck and the extension 254A of the needle cylinder 254. Less dispersion of the fibers is thus obtained, and therefore a greater economy of such fibers which can be relatively very valuable and which are not recoverable in full. Furthermore, there is obtained a reduction to the minimum of the possibility of breaking of the yarn forming the knitted manufactured article, as the manufactured article itself is formed independently of the violent descent of the fibers, freeing it therefore of considerable pressure and force.

It is advantageous to reduce to a minimum the structure of the tubular knitted manufactured article which is to tie the fibers inside it and through it. In order to obtain this, it is advantageous to work with only one needle or with a very limited number of needles and advantageously with a single tying-yarn feeder with a single yarn-guide 224. By these means, there is a lower percentage of tying yarn—which is usually a synthetic yarn—in relation to the quantity of opened fibers which the manufactured article succeeds in capturing. By these means, a final yarn which is very light is also obtained. The structure described of the device for the formation of the yarn is such that it makes it possible to effect twists also in the manufactured article which passes inside the continuous cavity of the shaft 252, so as firmly to capture the fibers without causing hardening of the structure of the final yarn. It is furthermore to be noted that, using a single rise of the needle, a considerable increase in production is possible—at least double the previous production—having the possibility of reducing the number of needles and of greatly lengthening the stitches of the tubular manufactured article. These and other aims will be clear to experts in the field.

It is understood that the drawing only shows an exemplary embodiment which is given only by way of practical demonstration of the invention, it being possible for the invention to vary in form and arrangement without moreover leaving the scope of the idea which forms the invention itself.

I claim:

1. A device for producing yarn, the device comprising:

feed means for transporting a plurality of loose open fibers in a stream of fluid, said feed means having an exit neck for receiving and for transporting said plurality of fibers; and knitting means including a needle operated around an exterior of said exit nozzle, said knitting means forming a tubular knitted article around said exit neck with said needle and incorporating a portion of said plurality of fibers inside said tubular knitted article during formation of the article, said feed means is spaced from a transport means allowing a portion of said stream of fluid to escape, wherein another portion of said plurality of fibers are carried by the escaping stream of fluid and are trapped in the knitted article.

2. A device in accordance with claim 1, wherein:

said feed means includes a rotating card means for receiving roving and separating said plurality of fibers from said roving, said feed means also defining a cavity for said transporting of said plurality of fibers to said exit neck; and said knitting means includes a tying yarn means for feeding tying yarns outside said exit neck to said needle of said knitting means, and around said exterior of said exit neck, said tying yarn means including a yarn-guide, said incorporating of said portion of fibers being with said tying yarn.

3. A device in accordance with claim 1, wherein:

said knitting means includes a plurality of needles operating around and surrounding a radial exterior of said exit neck.

4. A device in accordance with claim 3, wherein:

said transport means includes an axially hollow cylinder and said plurality of needles are slidingly guided on an exterior of said axially hollow cylinder, said tubular knitted article is developed within said axially hollow cylinder, and said axially hollow cylinder has an end spaced by a gap from said exit neck of said feed means, said knitting means also includes a cam means for controlling said plurality of needles, and moving said needle back and forth across said gap between said axially hollow cylinder and said exit neck.

5. A device in accordance with claim 4, wherein: said axially hollow cylinder defines substantially radial bores leading from an inside to an outside of said axially hollow cylinder, said substantially radial bores passing said stream of fluid after said another portion of said plurality of fibers have been trapped.

6. A device in accordance with claim 4, wherein: said axially hollow cylinder rotates.

7. A device in accordance with claim 6, wherein: said rotation of said axially hollow cylinder cooperates with said cam means for said controlling of said plurality of needles.

* * * * *